United States Patent [19]

Luzzi

[11] 4,354,721

[45] Oct. 19, 1982

[54] ATTACHMENT ARRANGEMENT FOR HIGH VOLTAGE ELECTRICAL CONNECTOR

[75] Inventor: Glenn J. Luzzi, Mount Bethel, Pa.

[73] Assignee: Amerace Corporation, New York, N.Y.

[21] Appl. No.: 221,779

[22] Filed: Dec. 31, 1980

[51] Int. Cl.[3] ..... H01R 13/52

[52] U.S. Cl. ..... 339/94 R; 339/111; 339/143 C

[58] Field of Search ..... 339/94 R, 111, 143 C, 339/59 R, 60 R; 174/72 R, 73 R, 74 R

[56] References Cited

U.S. PATENT DOCUMENTS

| | | | |
|---|---|---|---|
| 3,711,818 | 1/1973 | Swehla | 339/143 C X |
| 3,713,077 | 1/1973 | Leonard | 339/60 R X |
| 3,961,127 | 6/1976 | Gear et al. | 174/73 R X |
| 4,202,591 | 5/1980 | Borgstrom | 339/111 |

*Primary Examiner*—Eugene F. Desmond

*Attorney, Agent, or Firm*—Arthur Jacob; David Teschner; Richard A. Craig

[57] ABSTRACT

An attachment arrangement is carried by a bushing assembly of a high voltage electrical distribution system and facilitates attachment and securing of the bushing assembly to an electrical connector and subsequent attachment and securing of the electrical connector to a terminal of an electrical apparatus, the attachment arrangement including sequentially operated threaded elements having minimum torque responsive devices for assuring that the sequence of operation of the threaded elements will secure the bushing appropriately to the electrical connector and then will secure the electrical connector to the terminal.

21 Claims, 5 Drawing Figures

ATTACHMENT ARRANGEMENT FOR HIGH VOLTAGE ELECTRICAL CONNECTOR

The present invention relates generally to the connection and disconnection of high voltage electrical connector elements in the field and pertains, more specifically, to an attachment arrangement which assures the appropriate attachment and securing of a bushing assembly within an electrical connector, and the subsequent attachment and securing of the electrical connector to a terminal of a high voltage electrical apparatus.

In U.S. Pat. No. 4,202,591, granted May 13, 1980, and assigned to the assignee hereof, there is described a high voltage electrical connector of the type employed to connect a high voltage cable to the terminal of an electrical apparatus, such as a transformer, in a power distribution circuit. The electrical connector is provided with a bushing assembly which enables a ground connection to be made so as to ground the terminal without disconnecting the electrical connector.

It is an object of the present invention to provide an attachment arrangement which facilitates attachment and securing of a bushing assembly within an electrical connector of the type described in the aforesaid patent.

Another object of the present invention is to provide an attachment arrangement of the type described and which assures complete and appropriate attachment and securing of the bushing assembly within the electrical connector.

Still another object of the invention is to provide an attachment arrangement which facilitates the appropriate attachment and securing of the bushing assembly within the electrical connector in the field.

Yet another object of the invention is to provide an attachment arrangement of the type described and which eases attachment and securing of the electrical connector to the terminal of a high voltage electrical apparatus subsequent to the appropriate attachment and securing of the bushing assembly within the electrical connector.

A further object of the invention is to provide an attachment arrangement of the type described and which assures the appropriate, proper attachment and securing of the bushing assembly within the electrical connector prior to the attachment and securing of the electrical connector to the terminal.

A still further object of the invention is to provide an attachment arrangement of the type described and which is incorporated readily into a bushing assembly fully compatible with present electrical connectors of the type described.

Yet a further object of the invention is to provide an attachment arrangement of the type described and which is operated easily, in the field, without the necessity for elaborate and extensive special tools.

The above objects, as well as still further objects and advantages, are attained by the present invention which may be described briefly as an attachment arrangement for facilitating attaching and securing a bushing assembly within an electrical connector of a high voltage electrical distribution system, the electrical connector having an axially extending recess including a tapered portion, a terminal contact affixed to a conductor of a high voltage cable and including a portion extending into the recess, the terminal contact having a threaded aperture placed within the recess and aligned axially with the tapered portion of the recess, the bushing assembly including an axially extending tapered body portion complementary to the tapered portion of the recess in the electrical connector such that the complementary tapered portion will be engaged in an appropriate interference fit, the tapered body portion terminating at a terminal end, the attachment arrangement comprising: a tubular member extending in an axial direction within the bushing assembly adjacent the terminal end thereof and having an axially extending internal thread therein; a coupling member coupled with the tubular member and projecting axially beyond the terminal end of the tapered body portion of the bushing assembly, the coupling member including a first external thread at least a portion of which is spaced axially away from the tubular member for engaging the threaded aperture of the terminal contact, and a second external thread engaged with the internal thread of the tubular member; wrenching means associated with the tubular member for enabling rotation of the tubular member about the axial direction, the tubular member being so affixed within the bushing assembly as to assure concomitant rotation of the bushing assembly in response to said rotation of the tubular member; minimum torque responsive means for precluding relative movement between the tubular member and the coupling member below a predetermined torque exerted by the tubular member upon the coupling member; and stop means located such that upon insertion of the bushing assembly into the recess of the electrical connector and initial rotation of the bushing assembly, the coupling member will rotate with the bushing assembly, and the first external thread of the coupling member will be engaged within the threaded aperture of the terminal contact prior to the engagement of the complementary tapered portions in said interference fit, and continued rotation of the bushing member, as enabled by the wrenching means, will exceed the predetermined torque of the minimum torque means to further engage the second thread within the internal thread of the tubular member until the complementary tapered portions are engaged fully in the interference fit and proper electrical contact is made between the tubular member and the terminal contact. The attachment arrangement may include further minimum torque responsive means coupling the wrenching means with the tubular member for precluding relative rotation between the wrenching means and tubular member until a given torque is exceeded between the wrenching means and the tubular member, the given torque being of a value great enough to assure the aforesaid proper electrical contact between the tubular member and the terminal contact.

The invention will be more fully understood, while still further objects and advantages will become apparent, in the following detailed description of an embodiment of the invention illustrated in the accompanying drawing, in which.

Figure 1:
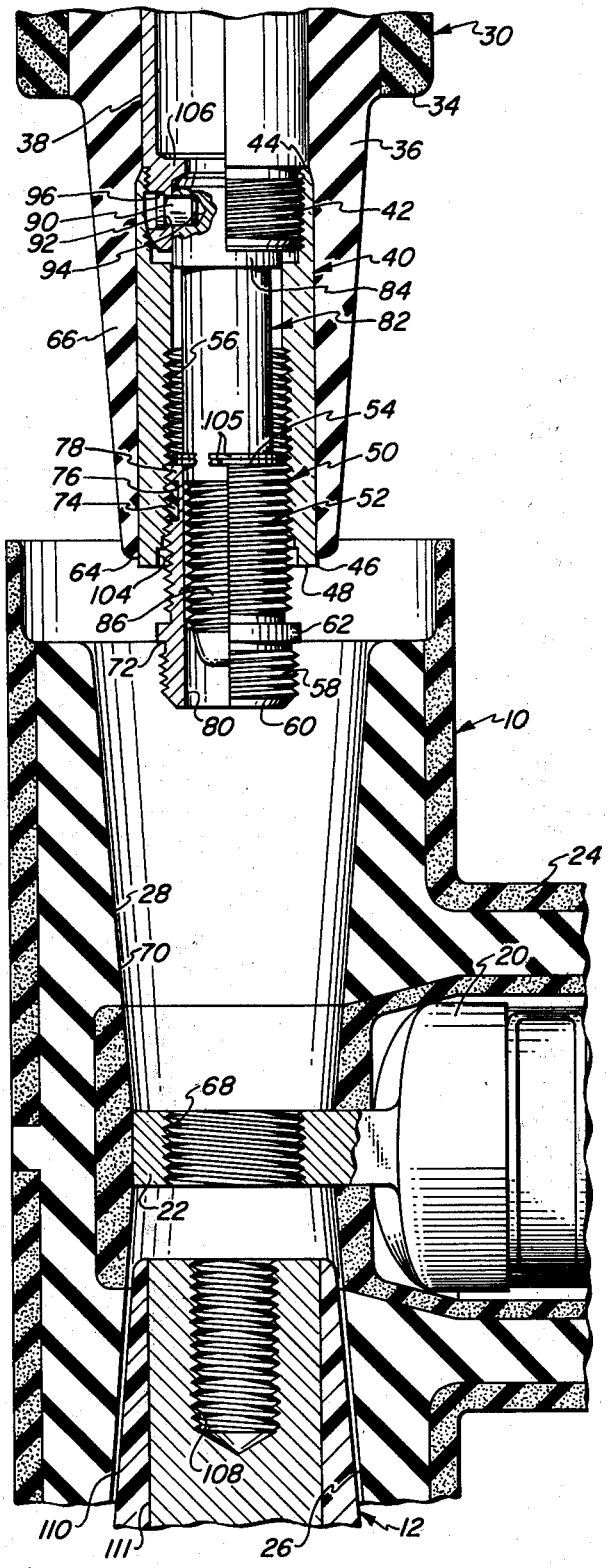
FIG. 1 is a fragmentary elevational cross-sectional view of a portion of a bushing assembly carrying an attachment arrangement constructed in accordance with the invention and showing the bushing assembly about to be installed within an electrical connector which is to be connected to a terminal of an electrical apparatus.

Referring now to the drawing, and especially to FIG. 1 thereof, the component parts depicted are similar to corresponding component parts illustrated and described in the aforementioned U.S. Pat. No. 4,202,591, in that the component parts include an electrical connector in the form of a T-shaped receptacle 10, and a terminal 12 of an electrical apparatus (not shown). The receptacle 10 is affixed to the terminus of a high voltage cable, in the manner illustrated in the aforesaid patent, and an electrical terminal contact 20 having an integral lug 22 is attached to the conductor of the cable. Lug 22 is to be connected to the terminal 12 to complete a distribution circuit.

A composite body 24 surrounds the contact 20 and provides an axially extending receptacle recess 26 within which terminal 12 is to be received. A second axially extending recess 28, opposite to first recess 26, is to receive interface bushing assembly 30 which is constructed to enable direct connection between the terminal 12 and a commonly available electrical connector, such as an elbow receptacle (not shown).

Bushing assembly 30 includes a generally tubular housing 34 having a body member 36 of dielectric material, such as an insulating elastomer, and a central tubular member 38 of conductive material, such as copper or aluminum. The upper end of the bushing assembly 30 is not illustrated, but is essentially the same as that shown in the aforesaid patent. Suffice it to say that a female contact assembly is located adjacent the upper end of the tubular member 38 and includes a female contact element which can receive a complementary male contact element for completing an electrical circuit to tubular member 38. In the present bushing assembly 30, tubular member 38 is provided with an extension in the form of an axially extending tubular extension member 40 of conductive material, such as copper or aluminum, affixed to tubular member 38 by means of a threaded connection 42 at the upper end 44 of tubular extension member 40. The lower end 46 of tubular extension member 40 includes a land 48 for purposes which will be described in greater detail below.

A coupling member 50, also constructed of conductive material such as copper or aluminum, is received within extension member 40, adjacent lower end 46, and is coupled to extension member 40 by means of an external thread 52 which extends axially to upper end 54 of coupling member 50 and engages a complementary internal thread 56 in extension member 40. A further external thread 58 extends along the coupling member 50 adjacent the lower end 60 thereof, and stop means in the form of a collar 62 is located axially between the external threads 52 and 58.

Figure 2:
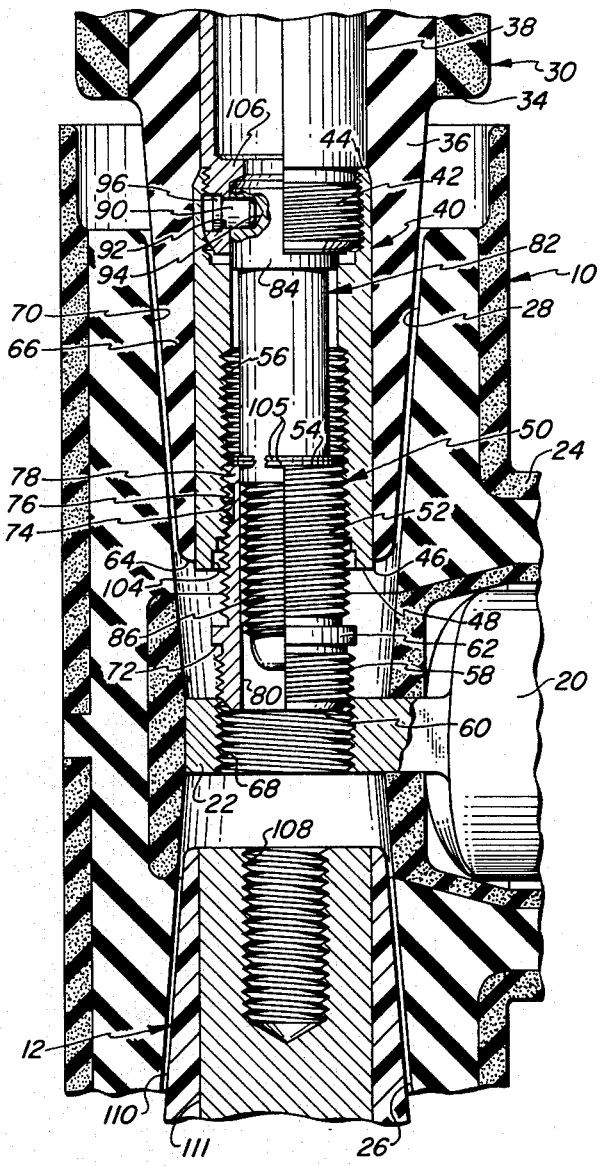
FIG. 2 is a fragmentary elevational cross-sectional view similar to FIG. 1, but with the component parts in another position.

Prior to the installation of bushing assembly 30 within the recess 28 of receptacle 10, coupling member 50 projects beyond the lower end 46 of extension member 40, and the lower end 64 of body member 36 of bushing assembly 30, with collar 62 spaced axially from lower ends 46 and 64, as illustrated in FIG. 1. In this manner, at least a portion of external thread 58 is spaced far enough downwardly from the tapered portion 66 of the body member 36 of bushing assembly 30 to enable external thread 58 to be engaged with a complementary threaded aperture 68 in lug 22 of contact 20, as seen in FIG. 2, without resistance which might otherwise occur if the tapered portion 66 of the body member 36 were to contact the corresponding tapered portion 70 of recess 28. Thus, at least a portion of external thread 58 of coupling member 50 may be threaded into threaded aperture 68 merely by turning bushing assembly 30 manually to advance external thread 58 into threaded aperture 68. Such advancement is continued until a sufficient axial length of external thread 58 is engaged within threaded aperture 68 to provide the holding strength necessary to complete the installation of the bushing assembly 30 within the receptacle 10, as described below, and preferably until a stop shoulder 72 on collar 62 is seated against lug 22, as seen in FIG. 3.

Preferably, manual turning of bushing assembly 30 will advance the coupling member 50 into threaded aperture 68 until stop shoulder 72 is seated properly against lug 22. A locking means is provided between the external thread 52 and the internal thread 56 to lock the coupling member 50 and the tubular extension member 40 against movement relative to one another during threading of the coupling member 50 into the lug 22, at least until the aforesaid sufficient axial length of thread 58 is engaged within threaded aperture 68. The locking means is in the form of a pellet 74 of synthetic resin material, such as nylon, placed within a recess 76 in the wall 78 of coupling member 50 and compressed against internal thread 56 of tubular extension member 40 to establish a prevailing torque great enough to preclude the unwanted relative movement, preferably until stop shoulder 72 is seated against lug 22. In order to effect continued rotation of the bushing assembly 30, and preferably after stop shoulder 72 is seated against lug 22, the prevailing torque provided by pellet 74 is overcome so that downward movement of the tapered body portion 66 into complementary tapered portion 70 of recess 28 can be continued. Thus, the pellet 74 provides a locking means which is responsive to a minimum torque, the minimum torque being of a predetermined value which will assure that the coupling member 50 is sufficiently engaged with lug 22, and preferably is engaged up to the position where stop shoulder 72 is seated against the lug 22, before tubular extension member 40 will move relative to coupling member 50. Pellet 74 assures that the minimum torque necessary to engage coupling member 50 sufficiently in lug 22 and preferably to seat coupling member 50 properly against lug 22 will be reached before extension member 50 moves relative to coupling member 50.

Figure 3:
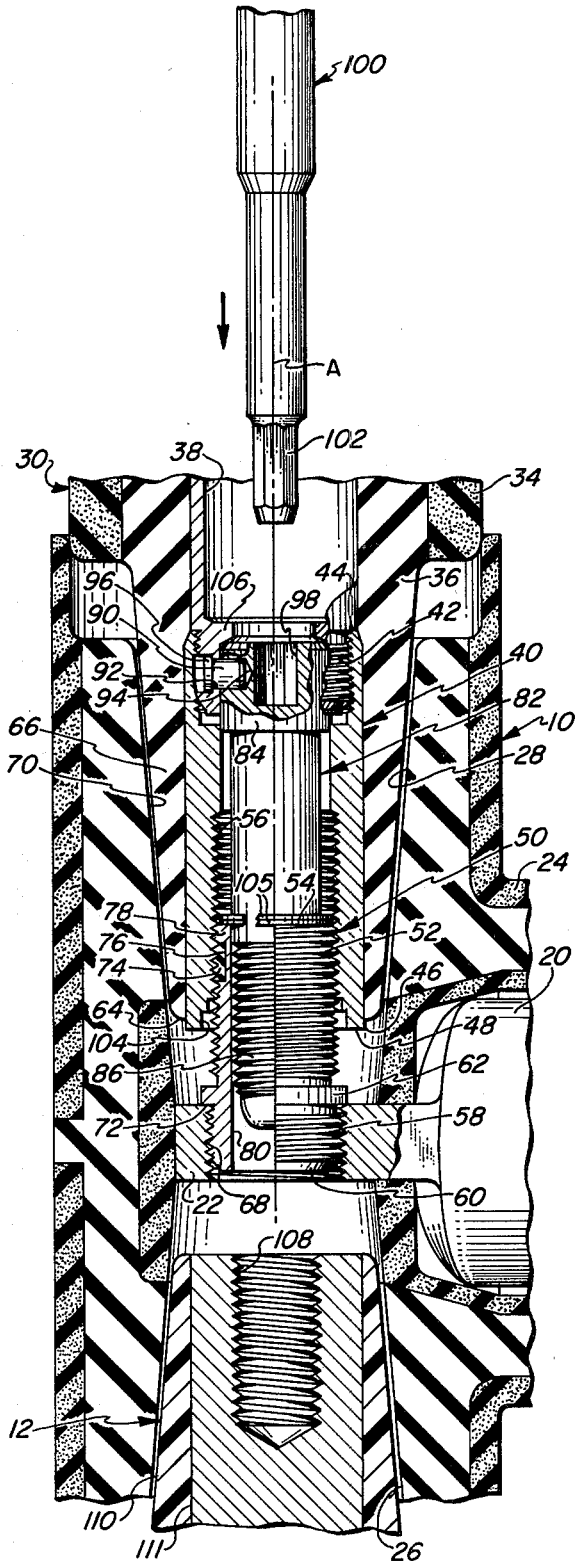
FIG. 3 is a fragmentary elevational cross-sectional view similar to FIG. 2, but with the component parts in still another position.

Upon proper seating of coupling member 50 within lug 22, as seen in FIG. 3, further rotation of bushing assembly 30 will overcome the lock provided by pellet 74 and the tapered body portion 66 of the bushing assembly 30 will begin to engage complementary tapered portion 70 of recess 28. Continued downward movement of the bushing assembly 30 will seat the bushing assembly 30 within the receptacle 10; however, such continued downward movement will meet with considerable resistance as a result of the interference fit which must be established between the complementary tapered portions 66 and 70 and in order to attain the desired watertight seal and dielectric properties along the interface between the engaged tapered portions. Since the body member 36 of bushing assembly 30 is constructed of elastomeric materials, it becomes impractical to grip the bushing assembly externally to exert the forces necessary to continue turning the bushing assembly as the resistance to turning increases with downward movement. The attachment arrangement of the present invention further provides an internal wrenching means for facilitating the continued rotation of the bushing assembly 30, as follows.

Figure 4:
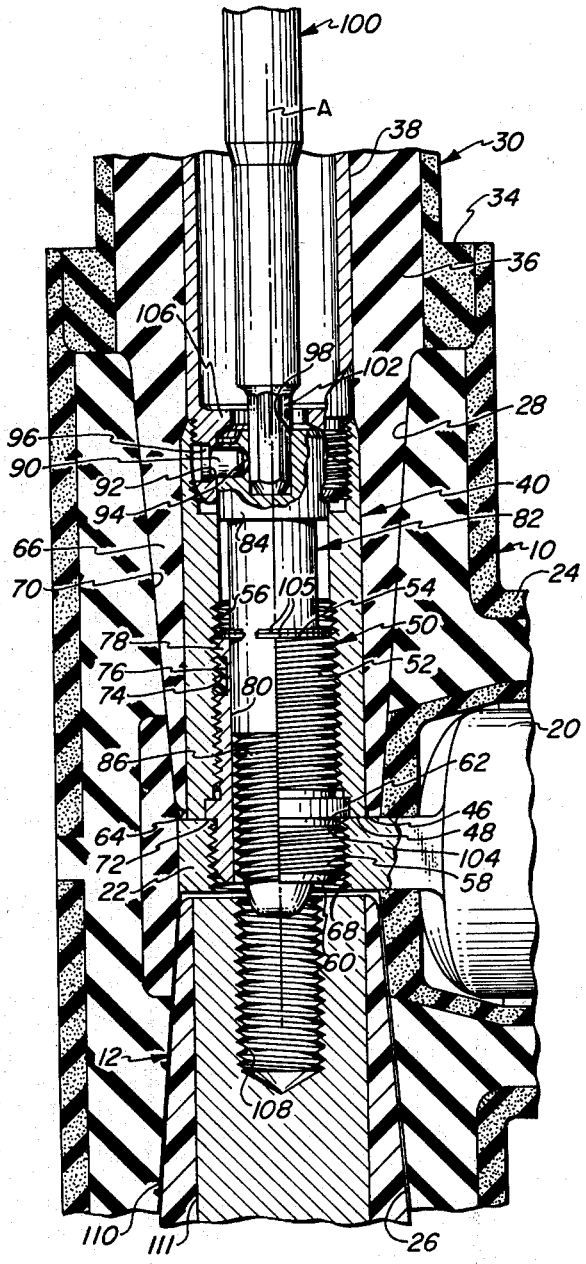
FIG. 4 is another similar fragmentary elevational cross-sectional view with the component parts in yet another position.

Turning now to FIGS. 3 and 4, coupling member 50 has a central bore 80 passing through the coupling member 50 from end 54 to end 60. A threaded fastener in the form of a bolt 82 extends axially within the bore 80 and has a head 84 and a thread 86. A pin 90 extends radially through an aperture 92 in the wall of tubular member 38 and into a corresponding hole 94 in the head 84 of bolt 82, the pin 90 having a flanged end 96 which serves to locate the pin 90 radially within aperture 92. Tubular extension member 40 overlaps the aperture 92 thereby capturing flanged end 96 of pin 90 within aperture 92. Bolt 82 thus is fixed in the retracted position illustrated in FIGS. 3 and 4.

A socket 98 in head 84 of bolt 82 provides a hexagonal wrenching configuration located along the central axis A of the bushing assembly 30. A tool 100, having a complementary hexagonal driving element 102 is lowered through the tubular member 38, along axis A, as seen in FIG. 3, and is inserted into socket 98, as seen in FIG. 4. The details of tool 100 are more fully disclosed in a United States patent application entitled ASSEMBLY TOOL FOR ELECTRICAL CONNECTORS, Ser. No. 221,780, filed of even date herewith, and assigned to the assignee hereof. For the purposes of the present disclosure, it is sufficient to understand that rotation of tool 100 about axis A, once the tool 100 is coupled with the head 84 of bolt 82, will impart concomitant rotation to bushing assembly 30 by virtue of the fact that head 84 is secured to tubular member 38 by pin 90. Wrenching forces then are applied and transmitted to move bushing assembly 30 downwardly until the land 48 at the lower end 46 of the tubular extension member 40 is seated against lug 22, as shown in FIG. 4, the collar 62 fitting within a corresponding recess 104 at the lower end 46 of extension member 40. If stop shoulder 72 of collar 62 has not yet been seated properly against lug 22, downward movement of extension member 40 now will carry coupling member 50 downwardly to assure proper seating of the coupling member 50 with lug 22. Once the land 48 is seated properly, the bushing assembly 30 will be seated within the receptacle 10 with the appropriate interference fit and land 48 will assure proper electrical contact between extension member 40 and lug 22 as well as an appropriate mechanical connection.

It is important that the bushing assembly 30 not be overtightened; that is, the land 48 must not gall the lug 22 and excessive forces should not be developed along the interface between the complementary tapered portions 66 and 70. At the same time, it is important that at least a minimum torque is applied sufficient to assure proper seating of bushing assembly 30 within receptacle 10. In order to preclude the application of excessive wrenching forces upon the bushing assembly 30, while assuring that the necessary minimum wrenching forces are applied, the shear strength of pin 90 is chosen so that pin 90 will shear in response to the application by tool 100 of a torque in excess of a given value determined by the minimum torque required for the appropriate seating of bushing assembly 30 within receptacle 10 and the maximum torque which can be tolerated. Thus, pin 90 serves as a further minimum torque responsive means which includes securing means for securing the head 84 of bolt 82 to tubular member 38 for applying wrenching torque, and the securing means releases in response to exceeding a given torque to preclude the application of an excessive torque to the connection between the bushing assembly 30 and the lug 22 while assuring that the necessary minimum torque is applied.

Figure 5:
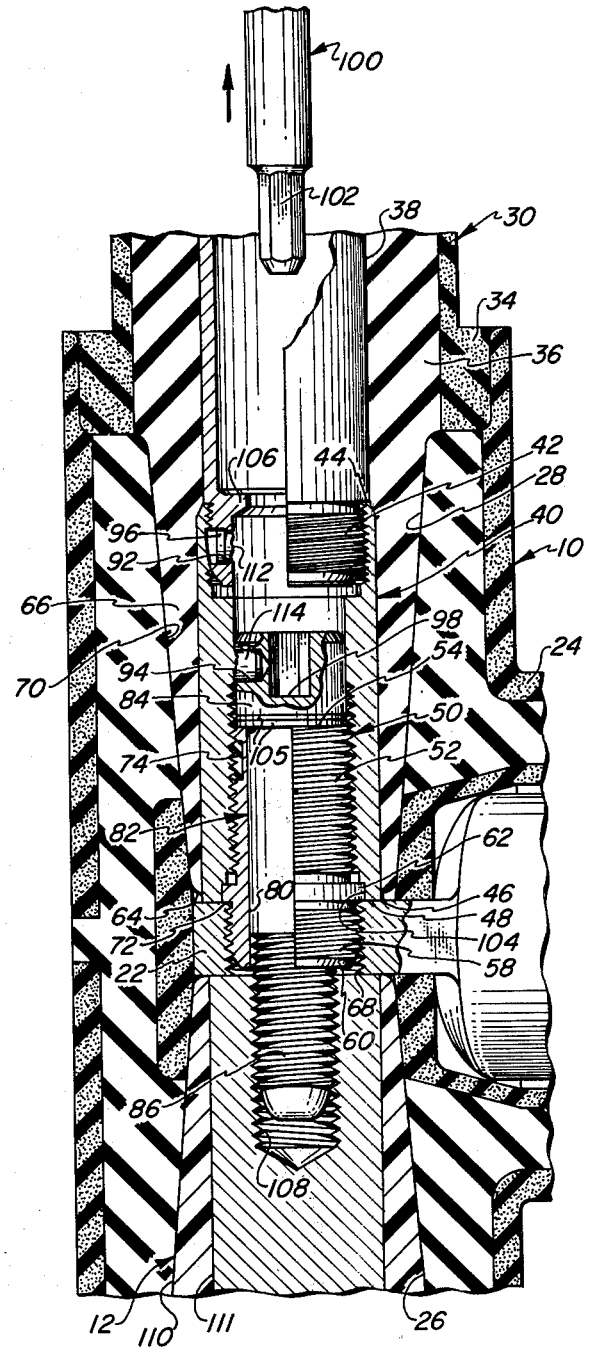
FIG. 5 is still another fragmentary elevational cross-sectional view showing all of the component parts fully connected.

Once the pin 90 is sheared, bolt 82 is free to move axially downwardly within tubular extension member 40 and coupling member 50, until the head 84 of bolt 82 rests upon washers 105 located at the upper end 54 of coupling member 50. It is noted that axially upward movement of bolt 82 is restricted by a lip 106 which projects radially inwardly to preclude movement of bolt 82 upwardly into tubular member 38 beyond lip 106. The receptacle 10, with bushing assembly 30 in place therein, ordinarily will be placed upon terminal 12 with the bolt 82 aligned axially with a threaded aperture 108 in terminal 12. Upon freeing of the bolt 82 by shearing of the pin 90, the bolt 82 may be advanced and threaded into the terminal 12, by rotation of tool 100, to complete the connection to the terminal 12, as shown in FIG. 5. In the completed connection, bolt 82 clamps lug 22 in place upon the terminal 12 and secures receptacle 10 upon terminal 12 with the appropriate interference fit at the interface between the recess 26 of the receptacle 10 and the corresponding outer surface 110 of the terminal 12 and the proper electrical contact between the lug 22 and the conductor 111 of terminal 12. It is noted that stop shoulder 72 of collar 62 is seated against lug 22 to preclude the projection of end 60 of coupling member 50 downwardly beyond lug 22 so as to assure proper contact between lug 22 and conductor 111 of terminal 12. Fragment 112 of sheared pin 90 is retained within aperture 92 in the wall of tubular member 38 by virtue of flanged end 96 so as to prevent the fragment from dropping freely into the bushing assembly 30 and possibly causing problems, such as falling into socket 98 and interfering with the appropriate engagement of hexagonal element 102 of tool 100. Likewise, fragment 114 of sheared pin 90 is confined within hole 94 of bolt head 84, by the wall of tubular extension member 40. Thus, the location of fragments 112 and 114 is controlled. Tool 100 then is withdrawn, as shown.

Thus, the attachment arrangement of the present invention facilitates the appropriate installation of the bushing assembly 30 within the receptacle 10 and then enables connection of the receptacle 10 to the terminal 12 in simplified operations performed readily in the field without complex tools.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. An attachment arrangement for facilitating attaching and securing a bushing assembly within an electrical connector of a high voltage electrical distribution system, the electrical connector having an axially extending recess including a tapered portion, a terminal contact affixed to a conductor of a high voltage cable and including a portion extending into the recess, the terminal contact having a threaded aperture placed within the recess and aligned axially with the tapered portion of the recess, the bushing assembly including an axially extending tapered body portion complementary to the tapered portion of the recess in the electrical connector such that the complementary tapered portion will be engaged in an appropriate interference fit, the tapered body portion terminating at a terminal end, said attachment arrangement comprising:

a tubular member extending in an axial direction within the bushing assembly adjacent the terminal end thereof and having an axially extending internal thread therein;

a coupling member coupled with the tubular member and projecting axially beyond the terminal end of the tapered body portion of the bushing assembly, the coupling member including a first external thread at least a portion of which is spaced axially away from the tubular member for engaging the threaded aperture of the terminal contact, and a second external thread engaged with the internal thread of the tubular member;

wrenching means associated with the tubular member for enabling rotation of the tubular member about the axial direction, the tubular member being so affixed within the bushing assembly as to assure concomitant rotation of the bushing assembly in response to said rotation of the tubular member;

minimum torque responsive means for precluding relative movement between the tubular member and the coupling member below a predetermined torque exerted by the tubular member upon the coupling member; and stop means located such that upon insertion of the bushing assembly into the recess of the electrical connector and initial rotation of the bushing assembly, the coupling member will rotate with the bushing assembly, and the first external thread of the coupling member will be engaged within the threaded aperture of the terminal contact prior to the engagement of the complementary tapered portions in said interference fit, and continued rotation of the bushing member, as enabled by the wrenching means, will exceed the predetermined torque of the minimum torque means to further engage the second thread within the internal thread of the tubular member until the complementary tapered portions are engaged fully in said interference fit and proper electrical contact is made between the tubular member and the terminal contact.

2. The invention of claim 1 wherein the stop means includes a stop shoulder located on the coupling member between the first and second external threads.

3. The invention of claim 1 or 2 including further minimum torque responsive means coupling said wrenching means with the tubular member for precluding relative rotation between the wrenching means and the tubular member until a given torque is exceeded between the wrenching means and the tubular member, the given torque being of a value great enough to assure said proper electrical contact between the tubular member and the terminal contact.

4. The invention of claim 3 wherein the attachment arrangement further facilitates attaching and securing the electrical connector to a terminal of an electrical apparatus, the terminal having a further thread thereon, said attachment arrangement further comprising:

a bore extending axially through the coupling member;

a threaded fastener located within the bore, the threaded fastener having a thread complementary to that of the further thread on the terminal; and the further minimum torque responsive means including securing means for securing the threaded fastener in a retracted position within the bore of the coupling member, the securing means securing the threaded fastener for rotation with the tubular member, and the wrenching means being located on the threaded fastener such that rotation of the threaded fastener, as enabled by the wrenching means, will result in concomitant rotation of the bushing assembly;

the securing means being releasable in response to exceeding said given torque between the threaded fastener and the tubular member to release the threaded fastener from the retracted position and enable advancement of the threaded fastener into threaded engagement with the terminal.

5. The invention of claim 4 wherein the securing means includes an element securing the threaded fastener to the tubular member, with the threaded fastener and the wrenching means thereon being accessible through the tubular member for rotation.

6. The invention of claim 5 wherein the element securing the threaded fastener to the tubular member is a pin capable of being sheared to release the threaded fastener for rotation relative to the tubular member in response to exceeding the given torque between the threaded fastener and the tubular member.

7. The invention of claim 4 wherein the threaded fastener is a bolt extending axially within the bore of the coupling member, the bolt including a head, and the wrenching means comprising a wrenching configuration in the head.

8. The invention of claim 7 wherein the securing means includes an element securing the head of the bolt to the tubular member, with the head and the wrenching means thereon being accessible through the tubular member for rotation.

9. The invention of claim 8 wherein the element securing the head of the bolt to the tubular member is a pin capable of being sheared to release the head for rotation relative to the tubular member in response to exceeding the given torque between the bolt and the tubular member.

10. The invention of claim 6 including means for capturing fragments of the pin subsequent to shearing of the pin to control the location of the fragments.

11. The invention of claim 1 wherein the value of said predetermined torque is such that said continued rotation of the bushing member will seat the stop means to preclude further rotation of the coupling member with the bushing assembly so that further rotation of the bushing assembly will be accomplished only by exceeding the predetermined torque.

12. The invention of claim 11 wherein the stop means includes a stop shoulder located on the coupling member between the first and second external threads, said stop shoulder being urged against the terminal contact when the stop means is seated.

13. The invention of claim 1, 11 or 12 wherein the minimum torque responsive means includes a prevailing torque mechanism placed between the internal thread of the tubular member and the second external thread of the coupling member.

14. The invention of claim 13 wherein the prevailing torque mechanism includes an element of synthetic resin material.

15. The invention of claim 14 wherein the element of synthetic resin material is a pellet located between the internal thread of the tubular member and the second external thread of the coupling member.

16. The invention of claim 13 including further minimum torque responsive means coupling said wrenching means with the tubular member for precluding relative rotation between the wrenching means and the tubular member until a given torque is exceeded between the wrenching means and the tubular member, the given torque being of a value great enough to assure said proper electrical contact between the tubular member and the terminal contact.

17. The invention of claim 16 wherein the prevailing torque mechanism includes an element of synthetic resin material.

18. The invention of claim 17 wherein the element of synthetic resin material is a pellet located between the internal thread of the tubular member and the second external thread of the coupling member.

19. The invention of claim 16 wherein the attachment arrangement further facilitates attaching and securing the electrical connector to a terminal of an electrical apparatus, the terminal having a further thread thereon, said attachment arrangement further comprising:

a bore extending axially through the coupling member;

a threaded fastener located within the bore, the threaded fastener having a thread complementary to that of the further thread on the terminal; and the further minimum torque responsive means including securing means for securing the threaded fastener in a retracted position within the bore of the coupling member, the securing means securing the threaded fastener for rotation with the tubular member, and the wrenching means being located on the threaded fastener such that rotation of the threaded fastener, as enabled by the wrenching means, will result in concomitant rotation of the bushing assembly;

the securing means being releasable in response to exceeding said given torque between the threaded fastener and the tubular member to release the threaded fastener from the retracted position and enable advancement of the threaded fastener into threaded engagement with the terminal.

20. The invention of claim 19 wherein the securing means includes an element securing the threaded fastener to the tubular member, with the threaded fastener and the wrenching means thereon being accessible through the tubular member for rotation.

21. The invention of claim 20 wherein the element securing the threaded fastener to the tubular member is a pin capable of being sheared to release the threaded fastener for rotation relative to the tubular member in response to exceeding the given torque between the threaded fastener and the tubular member.

* * * * *